US009450320B2

(12) United States Patent
Jung

(10) Patent No.: US 9,450,320 B2
(45) Date of Patent: Sep. 20, 2016

(54) FPCB CABLE AND CABLE CONNECTOR ASSEMBLY

(71) Applicant: SAMSUNG DISPLAY CO., LTD., Yongin-si, Gyeonggi-do (KR)

(72) Inventor: Dong Hun Jung, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/633,053

(22) Filed: Feb. 26, 2015

(65) Prior Publication Data

US 2016/0028174 A1 Jan. 28, 2016

(30) Foreign Application Priority Data

Jul. 22, 2014 (KR) ..... 10-2014-0092442

(51) Int. Cl.

| | |
|---|---|
| ***H01R 13/15*** | (2006.01) |
| ***H01R 12/88*** | (2011.01) |
| ***H01R 12/77*** | (2011.01) |
| *H01R 12/79* | (2011.01) |

(52) U.S. Cl.

CPC ..... *H01R 12/88* (2013.01); *H01R 12/77* (2013.01); *H01R 12/79* (2013.01)

(58) Field of Classification Search

CPC .... H01R 12/53; H01R 12/59; H01R 12/592; H01R 12/61; H01R 12/77; H01R 12/78; H01R 9/07; H01R 9/0764; H01R 23/66; H01R 23/667; H01R 23/668; H01R 12/79; H01R 12/88

USPC ..... 439/77, 67, 260, 329, 492, 493–495, 439/498, 499

See application file for complete search history.

(56) References Cited

U.S. PATENT DOCUMENTS

| | | | | | |
|---|---|---|---|---|---|
| 3,699,495 | A * | 10/1972 | Raynor | H01R 33/09 | 439/557 |
| 3,915,544 | A * | 10/1975 | Yurtin | H05K 3/326 | 439/747 |
| 3,999,826 | A * | 12/1976 | Yurtin | H01R 12/592 | 439/495 |
| 4,116,517 | A * | 9/1978 | Selvin | H05K 3/365 | 29/846 |
| 4,241,968 | A * | 12/1980 | Fukunaga | H01R 12/81 | 439/246 |
| 4,298,237 | A * | 11/1981 | Griffith | H01R 12/82 | 439/60 |
| 4,374,603 | A * | 2/1983 | Fukunaga | H01R 12/81 | 439/248 |
| 4,474,420 | A * | 10/1984 | Nestor | H01R 12/81 | 439/495 |
| 4,526,432 | A * | 7/1985 | Cronin | H01R 12/592 | 439/320 |

(Continued)

FOREIGN PATENT DOCUMENTS

| | | | | |
|---|---|---|---|---|
| JP | 2012-133933 A | 7/2012 | | |
| JP | EP 2600469 A2 * | 6/2013 | | H01R 12/73 |

(Continued)

*Primary Examiner* — Neil Abrams
*Assistant Examiner* — Travis Chambers
(74) *Attorney, Agent, or Firm* — Lewis Roca Rothgerber Christie LLP

(57) ABSTRACT

An FPCB cable and cable connector assembly includes: a conductive line unit including a signal (conductive) line; a terminal exposing a portion of the signal (conductive) line; a terminal protector extending from a side of the conductive line unit and surrounding the terminal; and a cable connector coupled to the terminal. The cable connector includes an actuator pivotably coupled to the cable connector and configured to fix the FPCB cable to the cable connector, and the terminal protector is configured to surround the cable connector such that the FPCB cable is not unintentionally detached from the cable connector.

16 Claims, 12 Drawing Sheets

(56) References Cited

U.S. PATENT DOCUMENTS 5,282,751 A * 2/1994 Lwee ..... H05K 1/0284 439/329
5,508,860 A * 4/1996 Takagi ..... G11B 5/5521 174/254
5,980,296 A * 11/1999 Mori ..... H01R 23/661 439/329
6,200,142 B1 * 3/2001 Soh ..... H01R 12/61 439/67
6,419,501 B1 * 7/2002 Okabe ..... H01R 12/79 439/77
6,462,279 B1 * 10/2002 Serizawa ..... B60Q 3/0203 174/72 A
6,537,082 B2 * 3/2003 Hopfer, III ..... H01R 12/62 439/493
6,969,274 B2 * 11/2005 Kudo ..... H01R 12/87 439/495
7,364,440 B2 * 4/2008 Gobron ..... H01R 13/025 439/77
7,374,430 B2 * 5/2008 Nagawatari ..... H01R 12/79 439/67
8,529,276 B2 * 9/2013 Esquivel ..... H01R 12/716 439/492
8,530,747 B2 * 9/2013 Kim ..... H05K 1/028 174/254
8,968,005 B2 * 3/2015 Hirakawa ..... H01R 12/73 439/65
2002/0020544 A1 * 2/2002 Okabe ..... H01R 13/741 174/68.1
2005/0202693 A1 * 9/2005 Kuo ..... G02F 1/13452 439/67
2008/0045077 A1 * 2/2008 Chou ..... H01R 4/027 439/495
2013/0115788 A1 * 5/2013 Broughton ..... H01R 12/61 439/67
2014/0134868 A1 5/2014 Sato et al.

FOREIGN PATENT DOCUMENTS

KR 10-2013-0024772 A 3/2013
KR 10-1286522 B1 7/2013
KR 10-2014-0008444 A 1/2014

* cited by examiner

FPCB CABLE AND CABLE CONNECTOR ASSEMBLY

CROSS-REFERENCE TO RELATED APPLICATION

This application claims priority to and the benefit of Korean Patent Application No. 10-2014-0092442, filed on Jul. 22, 2014 in the Korean Intellectual Property Office, the disclosure of which is incorporated herein in its entirety by reference.

BACKGROUND

1. Field

Aspects of embodiments of the present invention relate to a flexible printed circuit board (FPCB) cable and a cable connector.

2. Description of the Related Art

Display devices, such as televisions (TVs) and monitors, for outputting image information include an image display device configured to display images and a circuit device configured to output image signals for displaying images. With recent developments in information and communication technologies, there has arisen a demand for a variety of display devices and large-sized flat-panel display devices, such as a liquid crystal display (LCD) device and an organic light emitting diode (OLED) display device. These flat panel display devices generally include a flat display panel including a plurality of pixels and a circuit for supplying signals to the flat display panel.

The flat display panels generally include: a first substrate that includes signal (conductive) lines configured to supply signals for displaying images and switching elements configured to drive pixels formed on the first substrate; and a second substrate that is disposed to face and bonded to the first substrate.

The circuit generally includes: a system for supplying a signal and power for displaying images; a control substrate including a controller and the like configured to convert the signal supplied from the system into a signal to be supplied to the flat display panel; and a driver substrate configured to process the converted signal supplied from the control substrate and to supply the signal to the flat display panel.

A plurality of parallel signal (conductive) lines containing (e.g., transmitting) image information are disposed between the control substrate and the driver substrate. A flexible printed circuit board (FPCB) cable is often used.

In recent years, flat panel display devices have been used in large-sized TVs and the like such that a distance between FPCBs has increased, and thus, the FPCB cable coupling the FPCBs is lengthened and a weight of the FPCB cable itself is increased. Accordingly, the FPCB cable may be easily detached from a corresponding cable connector with even a little shock (e.g., external force).

It is to be understood that this background of the technology section is intended to provide useful background for understanding the technology, and as disclosed herein, this technology background section may include ideas, concepts, or recognitions that were not part of what was known or appreciated by those skilled in the pertinent art prior to the corresponding effective filing date of subject matter disclosed herein.

SUMMARY

Aspects of embodiments of the present invention is directed to an FPCB cable not easily detached from a cable connector when pressure or shock is applied in a direction in which the cable can be detached from the cable connector and to a cable connector assembly.

According to an embodiment of the present invention, a flexible printed circuit board (FPCB) cable and cable connector assembly includes: a conductive line unit including a signal (conductive) line; a terminal exposing a portion of the signal (conductive) line; a terminal protector extending from a side of the conductive line unit and surrounding the terminal; and a cable connector coupled to the terminal.

The cable connector may be between the terminal protector and the conductive line unit.

The terminal protector may be integrally formed with an insulating layer of the conductive line unit.

The terminal protector may include a conductive layer insulated from the signal (conductive) line.

The cable connector may include an actuator configured to fix the flexible printed circuit board (FPCB) cable to the cable connector.

The flexible printed circuit board (FPCB) cable may include a flexible printed circuit board.

The cable connector may have a groove at a side surface thereof, the groove opening in a direction away from the terminal.

According to an embodiment of the present invention, a flexible printed circuit board (FPCB) cable and cable connector assembly includes: a conductive line unit including a signal (conductive) line; a terminal exposing a portion of the signal (conductive) line; a terminal protector extending from a side of the conductive line unit and surrounding the terminal, the signal (conductive) line extending along at least a portion of the terminal protector; and a flexible printed circuit board cable connector, the terminal protector is configured to surround the cable connector.

The cable connector may be between the terminal protector and the conductive line unit.

The terminal protector may be integrally formed with an insulating layer of the conductive line unit.

The terminal protector may be integrally formed with at least an insulating layer of the conductive line unit.

The terminal may have a concave portion or a convex portion configured to be coupled to the cable connector.

The cable connector may include an actuator configured to fix the flexible printed circuit board (FPCB) cable to the cable connector.

The cable connector may have a groove at a same side surface at which the terminal is configured to be fixed to the cable connector.

According to an embodiment of the present invention, a flexible printed circuit board (FPCB) cable includes: a conductive line unit including a signal (conductive) line; a terminal exposing a portion of the signal (conductive) line; and a terminal protector extending from a side of the conductive line unit and surrounding the terminal.

According to an embodiment of the present invention, a flexible printed circuit board cable includes: a conductive line unit including a plurality of signal (conductive) lines; two terminals, each of the terminals exposing a portion of the signal (conductive) lines; and at least two terminal protectors coupled to respective ones of the terminals, extending from a side of the conductive line unit and surrounding the respective ones of the terminals, wherein the signal (conductive) lines extend along at least a portion of each of the terminal protectors.

The signal (conductive) lines may have substantially the same length as each other.

The terminal protectors may include a first terminal protector and a second terminal protector, and an innermost one of the signal (conductive) lines extending along the first terminal protector is an outermost one of the signal (conductive) lines extending along the second terminal protector.

The exposed portions of the signal (conductive) lines may each include an endpin connector having a concave shape or a convex shape.

The endpin connectors at one of the terminals are arranged in a zigzag manner.

According to aspects of embodiments of the present invention, a flexible printed circuit board cable includes a terminal protector extending from at least one side of a conductive line unit of the FPCB cable and is configured to surround an opposite surface of the mounting slot of the cable connector, thereby improving coupling reliability and preventing unintended detachment of the cable from the cable connector.

The foregoing is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The above and other features and aspects of the present invention will be more clearly understood from the following detailed description taken in conjunction with the accompanying drawings, in which.

DETAILED DESCRIPTION

Figure 1:
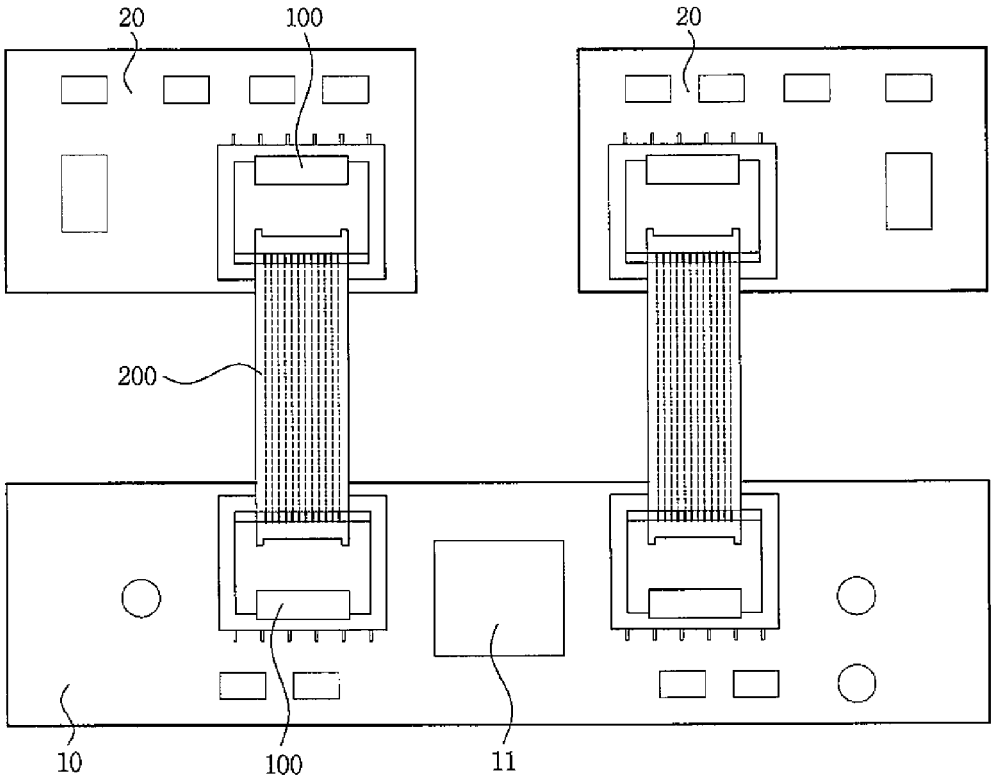
FIG.1 (Prior Art)
FIG. 1 is a plan view illustrating a state in which a conventional FPCB cable, a conventional connector assembly, and a conventional driver substrate are coupled to each other.

Hereinafter, embodiments of the present invention will be described in more detail with reference to the accompanying drawings.

Although the present invention can be modified in various different manners and has several embodiments, specific embodiments are illustrated in the accompanying drawings and will be mainly described in the specification. However, the scope of the embodiments of the present invention is not limited to the specific embodiments described herein and should be construed as including all the changes, equivalents, and substitutions included in the spirit and scope of the present invention.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" can be termed likewise without departing from the teachings herein.

It will be understood that when an element or layer is referred to as being "on", "connected to", or "coupled to" another element or layer, it may be directly on, connected, or coupled to the other element or layer or one or more intervening elements or layers may also be present. When an element is referred to as being "directly on", "directly connected to", or "directly coupled to" another element or layer, there are no intervening elements or layers present. As used herein, the term "and/or" includes any and all combinations of one or more of the associated listed items. Further, the use of "may" when describing embodiments of the present invention relates to "one or more embodiments of the present invention". Expression, such as "at least one of," when preceding a list of elements, modify the entire list of elements and do not modify the individual elements of the list. Also, the term "exemplary" is intended to refer to an example or illustration.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" or "over" the other elements or features. Thus, the term "below" may encompass both an orientation of above and below. The device may be otherwise oriented (rotated 90 degrees or at other orientations), and the spatially relative descriptors used herein should be interpreted accordingly.

The terminology used herein is for the purpose of describing particular example embodiments only and is not intended to be limiting of example embodiments. As used herein, the singular forms "a" and "an" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Further, when a first element is described as being "coupled" or "connected" to a second element, the first element may be directly coupled or connected to the second element or the first element may be indirectly coupled or connected to the second element via one or more intervening elements.

Some of the parts which are not directly associated with the description may not be provided in order to more clearly describe aspects of embodiments of the present invention, and like reference numerals refer to like elements throughout the specification.

Hereinafter, structure, aspects, and effects of the present invention will be described in detail with reference to the accompanying drawings.

FIG. 1 is a plan view illustrating a state in which a conventional FPCB cable, a conventional connector assembly, and a conventional driver substrate are coupled (e.g., connected) to each other.

Figure 2:
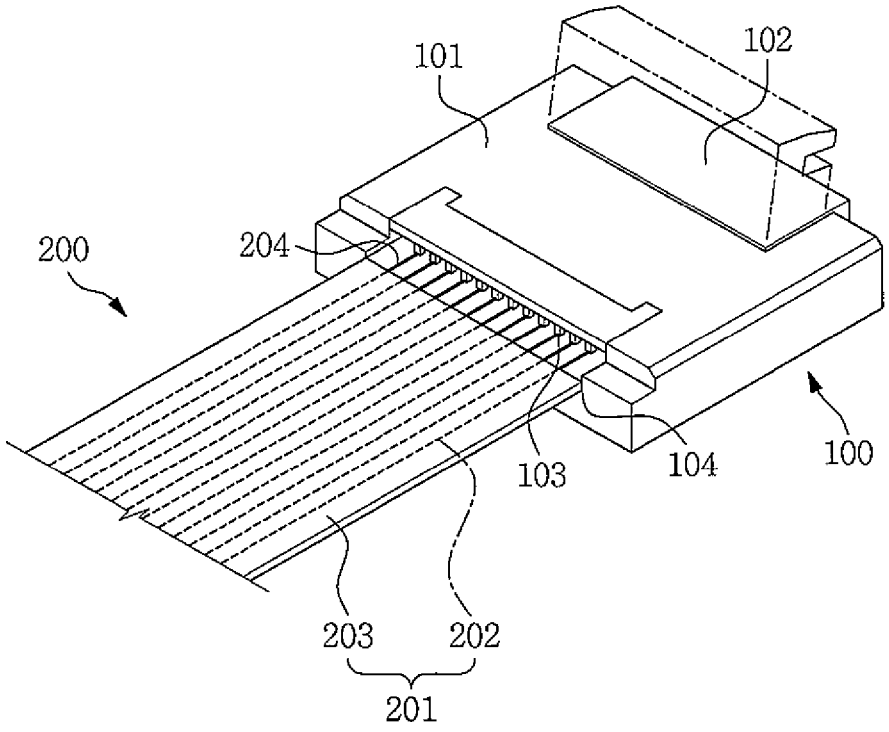
FIG.2 (Prior Art)
FIG. 2 is a perspective view illustrating a structure of a ZIF-type connector.

FIG. 2 is a perspective view illustrating a structure of a ZIF-type connector.

Hereinafter, a generally used FPCB cable coupled to a conventional connector assembly of a cable connector will be described with reference to FIGS. 1 and 2.

An FPCB cable 200 couples (e.g., connects) a control substrate 10 configured to output an image signal to a driver substrate 20 configured to receive the image signal from an integrated circuit (IC) chip 11. The FPCB cable 200 is detachable from cable connectors 100 coupled to respective ends thereof, and respective terminals of the FPCB cable 200 are electrically coupled to (e.g., electrically connected to) an endpin 103 of each cable connector 100. The endpin 103 is drawn out from (e.g., extends from) the cable connector 100 and is coupled to a conductive line unit of the FPCB cable. A ZIF-type connector including an actuator 102 to fix the FPCB cable 200 thereto is the cable connector 100.

A cable connector having a structure in which the side of the cable connector 100 at which the actuator 102 is located and a side of the cable connector 100 at which the FPCB cable 200 is inserted thereto are the same is called a front-side locking type connector, whereas a cable connector 100 having a structure in which the side of the cable connector 100 at which the actuator 102 is located and a side of the cable connector 100 at which the FPCB cable 200 is inserted thereto are opposite to each other is called a back-side locking type connector. FIG. 2 is a perspective view illustrating a structure of a back-side locking type cable connector.

Referring to FIG. 2, the conventional cable connector 100 includes a housing 101 formed of synthetic resins fixed on a substrate and the actuator 102 for fixing the FPCB cable 200 inserted at one side of the housing 101 to the housing 101.

In order to connect the FPCB cable 200 to the cable connector 100, the actuator 102 is rotated about a pivot point to be in an open or unlocked position, a terminal of the FPCB cable 200 is inserted to a mounting slot 104 of the housing 101, and subsequently, the actuator 102 is rotated about the pivot point to be in a closed or locked position.

Figure 3A:
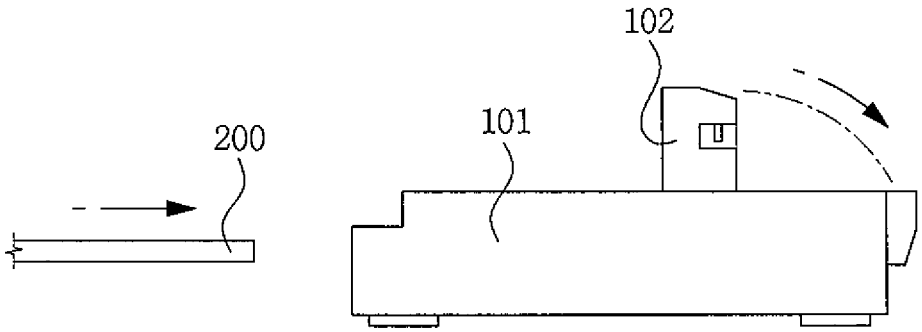
FIG.3A (Prior Art)
FIG. 3A is a side view illustrating a back-side locking type cable connector.

FIG. 3A is a side view illustrating the back-side locking type cable connector. The back side-locking type cable connector has a structure in which the actuator 102 of the connector is disposed at an opposite side of the housing 101 from the mounting slot 104. The FPCB cable 200 is inserted in a direction illustrated by the arrow and the actuator 102 is subsequently moved (e.g., rotated) in a direction along the dot-dash line to fix the FPCB cable 200 to the cable connector 100.

When the actuator 102 is moved upwards into a loosened or unlocked state, the FPCB cable 200 can be detached (e.g., removed) from the cable connector 100. The ZIF-type cable connector is capable of unlocking the FPCB cable 200 by only manipulating the actuator 102.

Figure 3B:
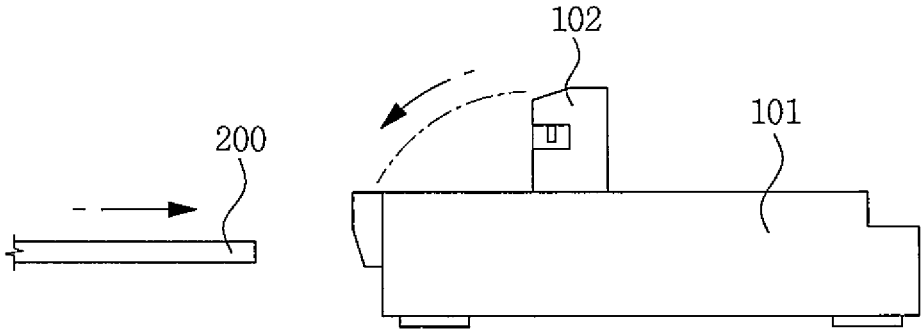
FIG.3B (Prior Art)
FIG. 3B is a side view illustrating a front-side locking type cable connector.

FIG. 3B is a side view illustrating a front-side locking type cable connector.

The front side-locking type cable connector has a structure in which the actuator 102 of the cable connector 100 is disposed at a side of the housing 101 that is the same as the side where the FPCB cable 200 is inserted into the housing (e.g., the same side as the mounting slot 104). The FPCB cable 200 is coupled to the cable connector 100 in the same way as in the back side-locking type cable connector.

Even when the actuator 102 is closed or locked, the cable connector 100 has weak fixation power. Thus, in a case when the FPCB cable 200 is pulled or the housing 101 is subjected to shock, the actuator 102 may be easily unlocked. Therefore, the fixation force applied to the FPCB cable 200 by the cable connector 100 may be weakened.

As described above, when the actuator 102 is closed, the fixation power may not be strong enough such that the actuator 102 may be opened due to external forces, thereby damaging a semiconductor circuit element in an operation. Further, the conventional cable connector 102 has a low component stability, which requires close attention of a user during a manufacturing process.

In addition, it is difficult to check whether the FPCB cable 200 is properly mounted in the mounting slot 104 of the cable connector 100, and thus, it is difficult to prevent an installation error during a mounting process.

Figure 4:
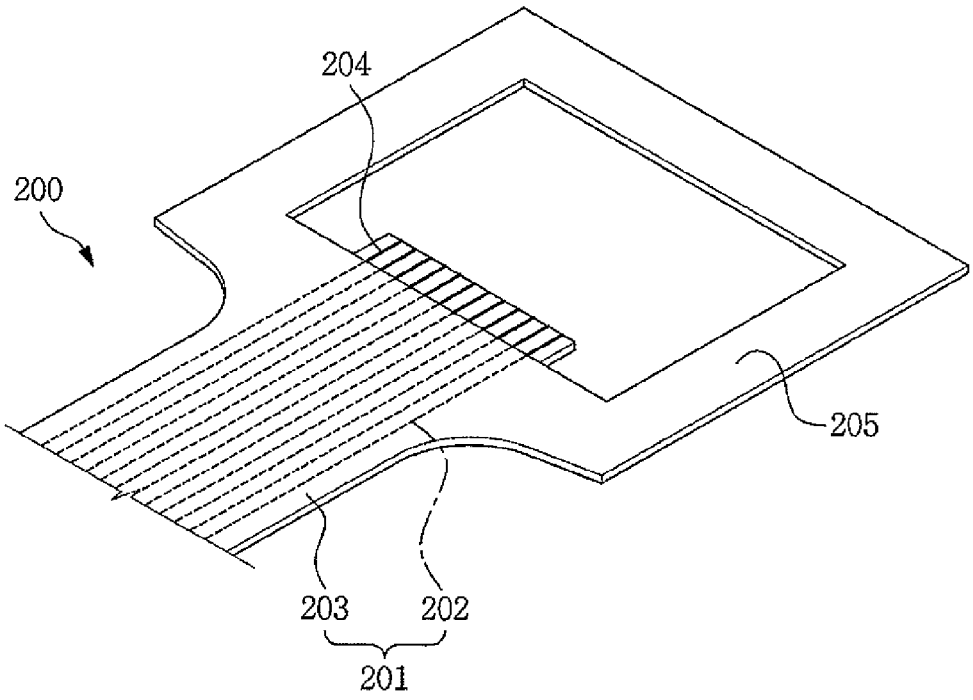
FIG. 4 is a perspective view illustrating an FPCB cable according to an embodiment of the present invention.

FIG. 4 is a perspective view illustrating an FPCB cable according to an embodiment of the present invention.

Referring to FIG. 4, the FPCB cable 200 includes a terminal protector 205 extending from a terminal of the FPCB cable 200 and a conductive line unit 201.

The FPCB cable 200 includes: a plurality of signal (conductive) lines 202; the conductive line unit 201 includes an insulating layer 203 that insulates the signal (conductive) lines 202; the terminal 204 extends from the conductive line unit 201 and exposing the signal (conductive) lines 202 (e.g., a portion of the signal lines 202) to be coupled to the endpin 103 of the cable connector 100; and the terminal protector 205 extending from sides (e.g., side terminals) of the conductive line unit 201 in a horizontal direction and surrounding a portion of the terminal 204 facing an inserting portion of the cable connector 100 into which the terminal 204 is to be inserted. For example, when coupled together, the cable connector 100 is disposed between the terminal protector 205 and the conductive line unit 201.

The conductive line unit 201 of the FPCB cable 200 includes the plurality of signal (conductive) lines 202 formed by patterning a conductive layer. Further, the conductive line unit 201 is formed by laminating the insulating layer 203 formed of an insulating film including materials, such as polyimide, on both an upper portion and a lower portion of the signal (conductive) lines 202. The signal (conductive) lines 202 may have a one-layer structure of a conductive layer but may have a multi-layer structure including a conductive layer. The signal (conductive) lines 202 insulated by the insulating layer 203 extend to the terminals 204 disposed at respective ends of the FPCB cable 200. At least a portion of the plurality of signal (conductive) lines 202 are disposed in parallel with each other.

The terminal 204 of the FPCB cable 200 extends from the conductive line unit 201 and has an area where a part (e.g., a portion) of the insulating layer 203 is removed to expose a part (e.g., a portion) of the signal (conductive) lines 202. When installed in the cable connector 100, the terminal 204 is in contact with and is electrically coupled to the endpin 103 of the FPCB cable connector 100.

The terminal protector 205 extends from the sides of the conductive line unit 201 and is shaped to surround the housing 101 of the cable connector 100. The terminal protector 205 may be integrally formed with and extend from the insulating layer 203 of the conductive line unit 201. For example, the terminal protector 205 may include an outermost insulating layer from among the insulating layer 203 of the conductive line unit 201.

The terminal protector 205 may not necessarily include only the insulating layer 203. An additional conductive layer insulated from the signal (conductive) lines 202 or additional structure may be included.

Figure 5:
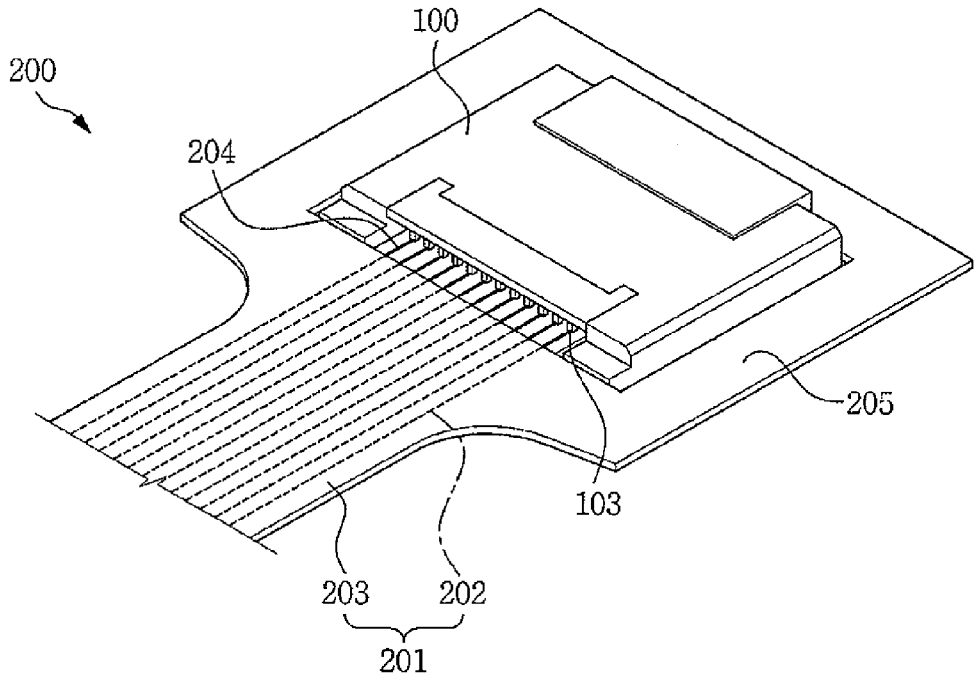
FIG. 5 is a perspective view illustrating a state in which the FPCB cable shown in FIG. 4 is coupled to a cable connector.

FIG. 5 is a perspective view illustrating a state in which the FPCB cable 200 of FIG. 4 is coupled to a cable connector 100.

In a state in which the FPCB cable 200 is coupled to the cable connector 100, the cable connector 100 is disposed at an area surrounded by the terminal protector 205, the conductive line unit 201, and the terminal 204. Further, the terminal protector 205 is spaced from (e.g., spaced apart from) the cable connector housing 101 disposed to face the terminal 204 of the FPCB cable 200 by a gap (e.g., a predetermined gap). However, the terminal protector 205 and the cable connector housing 101 may be in contact with each other when the terminal 204 is locked into the cable connector housing 101. For example, the terminal protector 205 and the cable connector housing 101 may be in contact with each other when the FPCB cable 200 is acted upon by an external force.

In an embodiment in which the cable connector 100 is disposed within an area formed by the FPCB cable 200, one can visibly check that the terminal 204 of the FPCB cable 200 is properly coupled to the endpin 103 of the cable connector 100. When the terminal 204 of the FPCB cable 200 is not inserted or wrongly inserted into the cable connector 100, the cable connector 100 may not be properly disposed within a space between the conductive line unit 201 of the FPCB cable 200 and the terminal protector 205. Therefore, by only checking the relative positions of the cable connector 100 and the FPCB cable 200, a coupling state of the cable can be ascertained. When the inner space formed by the FPCB cable 200 corresponds to the position of the cable connector housing 101 (e.g., when the cable connector housing 101 is within the space formed by the FPCB cable 200), problems of not-inserting, erroneously-inserting, and/or post-installation detachment can be easily recognized.

Further, when the FPCB cable 200 is subject to shock in a direction opposite to an inserting direction of the FPCB cable 200 into the cable connector housing 101 when the FPCB cable 200 is coupled to the cable connector 100, the terminal protector 205 of the FPCB cable 200 is brought into contact with the housing 101 of the cable connector 100. Although a force may be constantly applied, the terminal protector 205 extending from the conductive line unit 201 of the FPCB cable 200 is in contact with the housing 101 of the cable connector 100 such that the force pulling the FPCB cable 200 cannot lead to detachment from the cable connector 100. A double detachment protective mechanism including the actuator 102 of the cable connector 100 and the terminal protector 205 leads to strong coupling reliability of the FPCB cable 200 to the cable connector 100.

Figure 6:
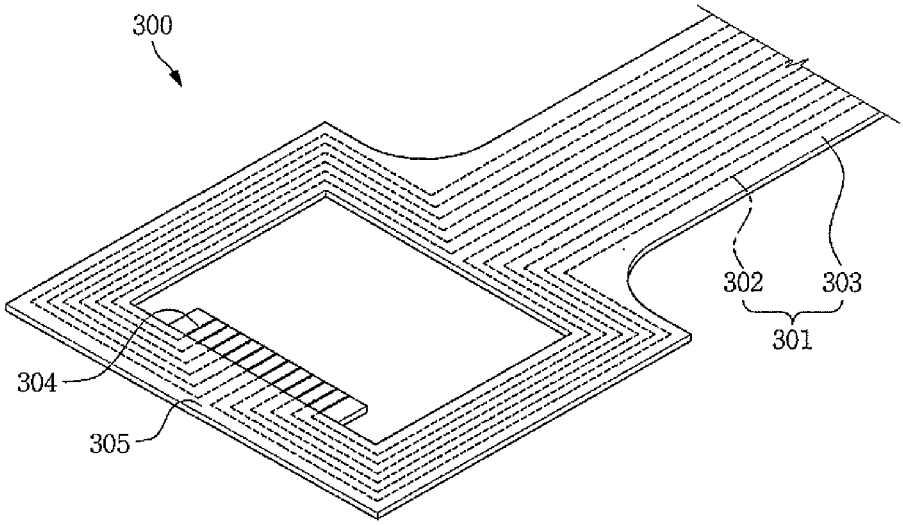
FIG. 6 is a perspective view illustrating an FPCB cable according to another embodiment of the present invention.

FIG. 6 is a perspective view illustrating an FPCB cable 300 according to another embodiment of the present invention.

Referring to FIG. 6, signal (conductive) lines 302 extend to a terminal 304 along a terminal protector 305 extending from a conductive line unit 301. The terminal 304 of the FPCB cable 300 is spaced from (e.g., spaced apart from) the conductive line unit 301 and disposed to face an inner side of an area surrounded by the terminal protector 305. For example, an extension direction of the terminal 304 is the same or substantially the same as a direction of force pulling the conductive line unit 301.

For example, the signal (conductive) lines 302 of the conductive line unit 301 extend along (or in) the terminal protector 305 around the housing 101 of the cable connector 100 to the terminal 304 of the FPCB cable 300 disposed at a rear surface of the cable connector 100. The mounting slot 104 of the cable connector is disposed to face the terminal 304 of the FPCB cable 300. For this purpose, the cable connector 100 is disposed on the substrate having the mounting slot 104 face the terminal 304 of the FPCB cable 300.

Figure 7:
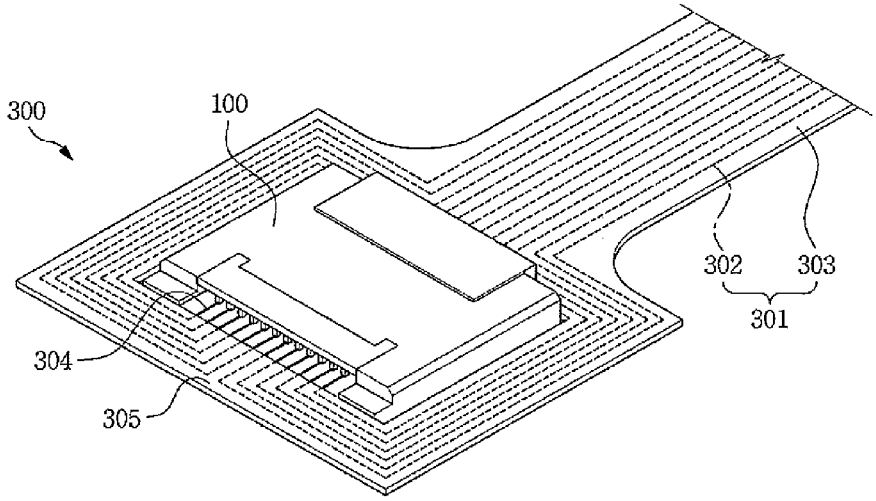
FIG. 7 is a perspective view illustrating a state in which the FPCB cable according to another embodiment of the present invention is coupled to a cable connector.

FIG. 7 is a perspective view illustrating a state in which the FPCB cable according to another embodiment of the present invention is coupled to a cable connector.

Referring to FIG. 7, in the cable connector assembly according to another embodiment of the present invention, after the FPCB cable 300 is mounted on (e.g., coupled to) the cable connector 100, although the FPCB cable 300 may be pulled by the weight of the FPCB 300 itself or by negligence of a user, the FPCB cable 300 is subject to force in a direction parallel to a direction in which the FPCB cable 300 is coupled to the cable connector 100, such that the FPCB cable is not detached from the cable connector.

Further, in a case where the FPCB cable 300 is lifted upwards, the terminal 304 disposed in a direction facing the conductive line unit 301 and the cable connector 100 is not subject to the lifting effect, such that the actuator 102 is not loosened. Although the FPCB cable 300 is moved, the FPCB cable 300 is not detached from the cable connector 100, which makes the FPCB cable connector assembly desirable to be used in, for example, a portable device.

Figure 8:
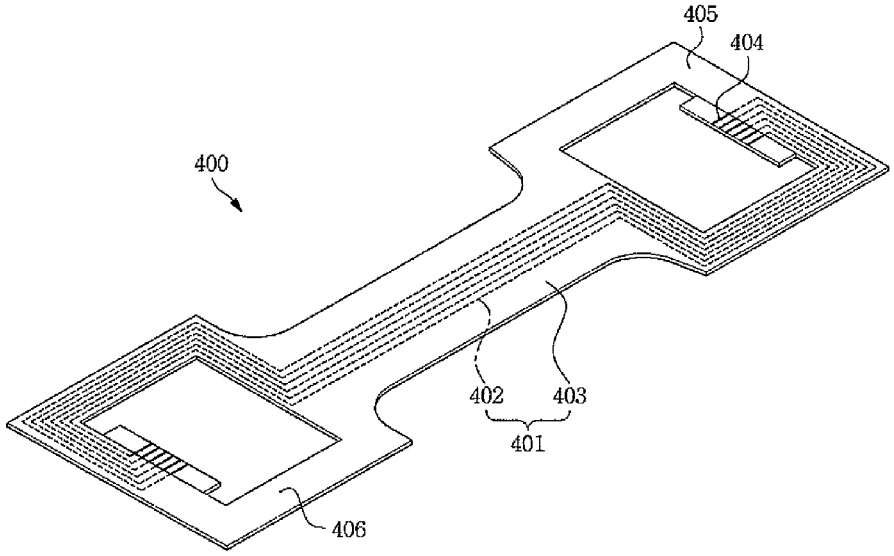
FIG. 8 is a perspective view illustrating an FPCB cable according to yet another embodiment of the present invention.

FIG. 8 is a perspective view illustrating an FPCB cable 400 according to yet another embodiment of the present invention.

Referring to FIG. 8, signal (conductive) lines 402 of the FPCB cable 400 may have substantially the same length as each other although the signal (conductive) lines 402 extend to surround the cable connector 100.

Referring to FIG. 8, the signal (conductive) lines 402 of the FPCB 400 include a first terminal protector 405 configured to keep lengths of the respective signal (conductive) lines 402 the same regardless of the position of the signal (conductive) lines 402. The signal (conductive) lines 402 extend from one end portion of the conductive line unit 401 to one side of the terminal protector 405, for example, to the right. For example, the signal (conductive) lines 402 extend either to the right- or to the left-hand direction of the first terminal protector 405 with respect to the conductive line unit 401. Further, the signal (conductive) lines 402 extend from the other end portion of the conductive line unit 401 to the other side (e.g., extend to the other direction) of a second terminal protector 406, for example, to the left. It is also contemplated that the signal (conductive) lines 402 may extend to only one side of the terminal protector in an embodiment in which the signal (conductive) lines 402 are formed on one layer and the signal (conductive) lines 402 may extend to both sides of the terminal protector in an embodiment in which the signal (conductive) lines 402 are formed on a conductive layer having a multi-layer structure.

According to the above-described structure, the signal (conductive) line 402 disposed at an outermost side of the terminal protector 405 at one end portion of the FPCB cable 400 are disposed at an innermost side of another terminal protector 406 at the other end portion of the FPCB cable 400, such that the lengths of the respective lines 402 extending along the terminal protectors 405 and 406 can be offset between one end portion and the other end portion. The signal (conductive) lines 402 are coupled to respective cable connectors 100 at both terminals of the FPCB cable 400, such that the lengths of the signal (conductive) lines 402 formed as a single-layer structure are the same or substantially the same between the cable connectors at both of the terminals.

Figure 9A:
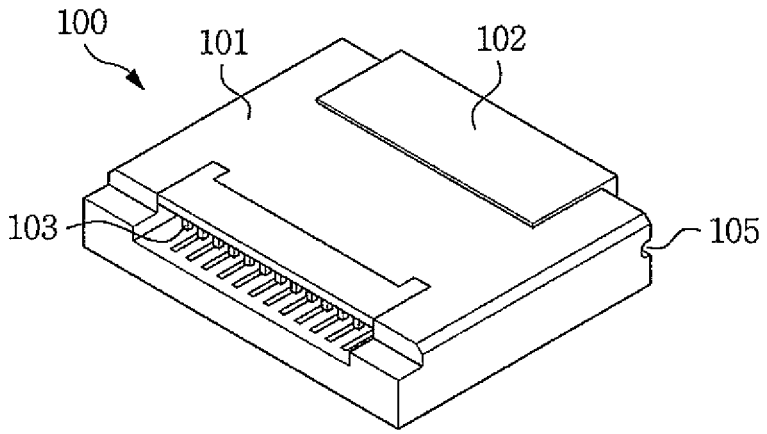
FIG. 9A is a perspective view illustrating a cable connector having a groove formed on a rear surface thereof.

FIG. 9A is a perspective view illustrating a cable connector having a groove formed on a rear surface.

Figure 9B:
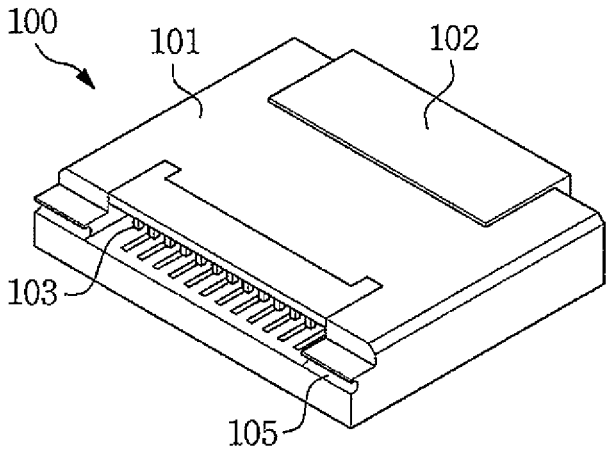
FIG. 9B is a perspective view illustrating a cable connector having a groove formed on a front surface thereof.

FIG. 9B is a perspective view illustrating a cable connector having a groove formed on a front surface.

Figure 10:
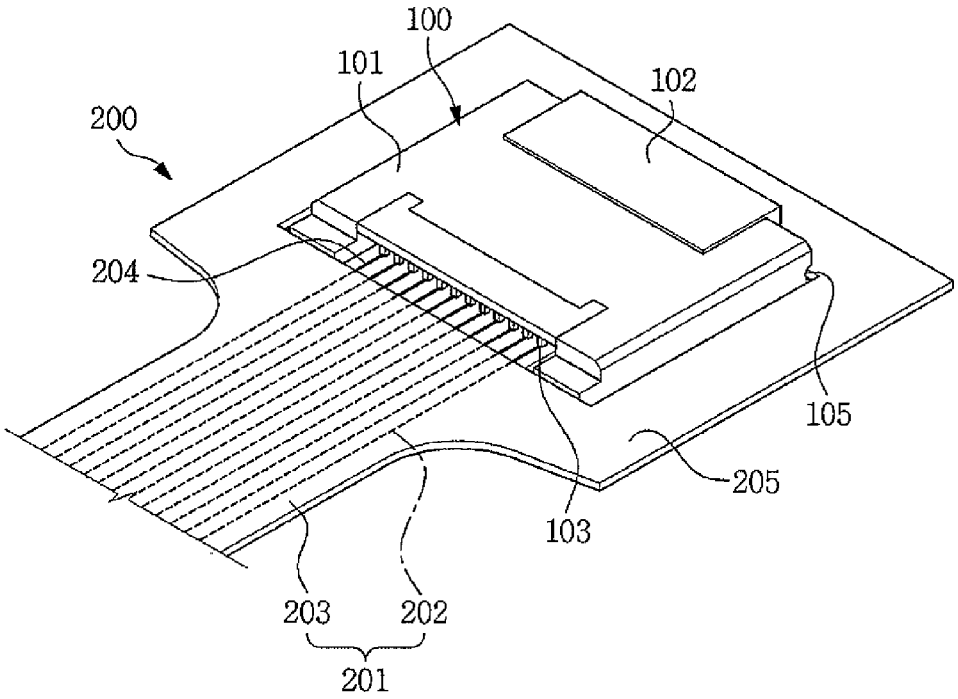
FIG. 10 is a perspective view illustrating a state in which the FPCB cable is coupled to an FPCB cable connector having a groove.

FIG. 10 is a perspective view illustrating a state in which an FPCB cable is coupled to a cable connector having a groove.

Referring to FIGS. 9 to 10, the housing 101 of the cable connector 100 has a groove 105 corresponding to the terminal protector of the FPCB cable. When the FPCB cable 200 is moved in a direction to be detached from (e.g., away from) the cable connector 100 by the weight of the FPCB cable 200 itself or an external force, the FPCB cable 200 engages (e.g., contacts) the groove 105 of the cable connector 100, which may prevent the FPCB cable 200 from sliding out (or sliding over) and being detached from the housing 101 of the cable connector 100.

FIG. 9A is a perspective view illustrating the cable connector 100 configured to be coupled to the FPCB cable 200 of FIG. 4 according to an embodiment of the present invention. The cable connector housing 101 has the groove 105 on one side surface thereof at an opposite side surface as the endpin 103 of the connector.

FIG. 9B is a perspective view illustrating the cable connector 100 configured to be coupled to the FPCB cable 300 or 400 of FIGS. 6 to 8 according to another embodiment of the present invention. The cable connector housing 101 has a groove at one side surface of the housing 101 at which the terminal of the FPCB cable is coupled. The groove is formed to have a height from a bottom of the housing 101 that is substantially the same as a height at which the FPCB cable is mounted to the mounting slot 104 (e.g., the groove 105 is aligned with the FPCB cable when the FPCB cable is mounted to the housing 101).

Referring to FIG. 10, the groove 105 of the cable connector may be formed to have a height above a bottom of the housing 101 that is substantially the same as a height of the terminal 204 when it is fixed to the cable connector 100. When the actuator 102 is locked and force is applied to the FPCB cable 200 in a direction to be detached from the cable connector 100, the FPCB cable 200 is moved to be in (e.g., stuck in) the groove 105 of the cable connector 100. In this embodiment, although the force is constantly applied, the FPCB cable 200 is not detached from the cable connector 100.

Figure 11:
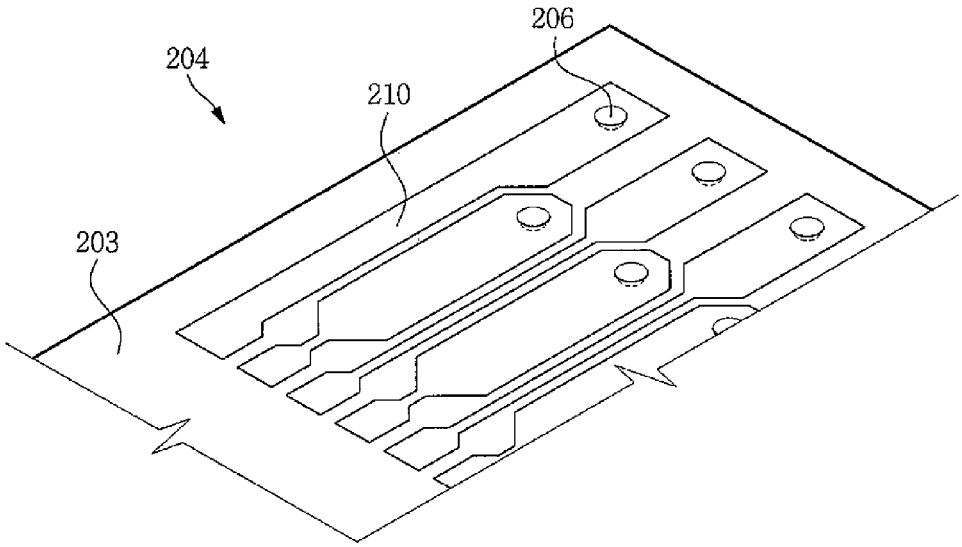
FIG. 11 is a perspective view illustrating a terminal of the FPCB cable according to an embodiment of the present invention.

FIG. 11 is a perspective view illustrating the terminal of the FPCB cable according to an embodiment of the present invention.

Figure 12:
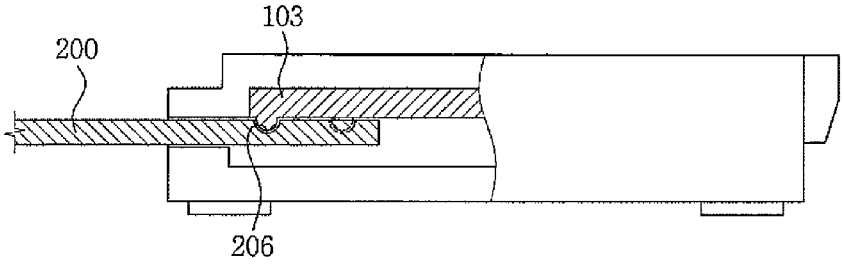
FIG. 12 is a cross-sectional view illustrating a state in which the terminal of the FPCB cable according to an embodiment of the present invention is coupled to an endpin of a cable connector.

FIG. 12 is a cross-sectional view illustrating a state in which the terminal of the FPCB cable according to an embodiment of the present invention is coupled to the endpin of the cable connector.

Referring to FIGS. 11 and 12, according to an embodiment of the present invention, the terminal 204 of the FPCB cable 200 has a structure in which exposed portions of the signal (conductive) lines are disposed to be adjacent to each other and are alternately formed (e.g., arranged) in a zigzag manner. In an embodiment in which the exposed portions of the signal (conductive) lines (e.g., terminals 210 of the signal lines 202) are alternately disposed, a width of the terminals 210 corresponding to respective ones of the signal (conductive) lines 202 can be increased (e.g., expanded). The expanded width of the terminals increases a contact surface to be coupled to the endpin 103 of the connector cable 100 and may decrease contact resistance therebetween. An endpin connector 206 can be additionally provided to each terminal 210 of the FPCB cable in a corresponding area that will be coupled to the endpin of the cable connector. The endpin connector 206 may have a concave shape or a convex shape formed by applying a pressure (e.g., a predetermined pressure) to an exposed area of each of the terminals 210. When the endpin has a convex shape, the endpin connector 206 may have a corresponding concave shape. Further, when the endpin has a concave shape, the endpin connector 206 may have a corresponding convex shape.

From the foregoing, it will be appreciated that various embodiments in accordance with the present disclosure have been described herein for purposes of illustration and that various modifications may be made without departing from the scope and spirit of the present teachings. Accordingly, the various embodiments disclosed herein are not intended to be limiting of the true scope and spirit of the present teachings as defined by the appended claims and their equivalents.

What is claimed is:

1. A FPCB cable and cable connector assembly comprising:

a conductive line unit comprising a signal line;

a terminal, a portion of the signal line being exposed at the terminal;

a terminal protector extending from a side of the conductive line unit and surrounding the terminal; and a cable connector coupled to the terminal, the cable connector comprising an actuator pivotably coupled to the cable connector and configured to fix the FPCB cable to the cable connector, wherein the terminal protector is configured to surround the cable connector.

2. The FPCB cable and cable connector assembly of claim 1, wherein the cable connector is between the terminal protector and the conductive line unit.

3. The FPCB cable and cable connector assembly of claim 1, wherein the FPCB cable comprises a flexible printed circuit board.

4. The FPCB cable and cable connector assembly of claim 1, wherein the cable connector has a groove formed at a side surface thereof and opens in a direction away from the terminal.

5. The FPCB cable and cable connector assembly of claim 1, wherein the terminal protector is integrally formed with an insulating layer of the conductive line unit.

6. The FPCB cable and cable connector assembly of claim 5, wherein the terminal protector comprises a conductive layer insulated from the signal line.

7. An FPCB cable and cable connector assembly comprising:

a conductive line unit comprising a signal line, the conductive line unit extending in a first direction;

a terminal, a portion of the signal line being exposed at the terminal;

a terminal protector extending from a side of the conductive line unit in the first direction and surrounding the terminal; and a flexible printed circuit board cable connector, wherein the terminal protector forms an opening having a closed periphery that is configured to surround the cable connector, and wherein the signal line extends along at least a portion of the terminal protector such that the terminal extends into the opening formed by the terminal protector at an area other than at the side of the conductive line unit from which the terminal protector extends.

8. The FPCB cable and cable connector assembly of claim 7, wherein the cable connector is configured to be arranged between the terminal protector and the conductive line unit.

9. The FPCB cable and cable connector assembly of claim 7, wherein the terminal protector is integrally formed with an insulating layer of the conductive line unit.

10. The FPCB cable and cable connector assembly of claim 7, wherein the terminal has a concave portion or a convex portion configured to be coupled to the cable connector.

11. The FPCB cable and cable connector assembly of claim 7, wherein the cable connector comprises an actuator pivotably coupled to the cable connector and configured to fix the flexible printed circuit board cable to the cable connector.

12. The FPCB cable and cable connector assembly of claim 7, wherein the cable connector has a groove at a same side surface at which the terminal is configured to be fixed to the cable connector.

13. An FPCB cable comprising:

a conductive line unit comprising a plurality of signal lines;

at least two terminals, each of the terminals exposing a portion of the signal lines; and at least two terminal protectors coupled to respective ones of the terminals, extending from a side of the conductive line unit, and surrounding the respective ones of the terminals, wherein the signal lines extend along at least a portion of each of the terminal protectors, and wherein the signal lines have substantially the same length as each other.

14. The FPCB cable of claim 13, wherein the exposed portions of the signal lines each comprise an endpin connector having a concave shape or a convex shape.

15. The FPCB cable of claim 14, wherein the endpin connectors at one of the terminals are arranged adjacent to each other in a zigzag manner.

16. An FPCB cable comprising:

a conductive line unit comprising a plurality of signal lines;

at least two terminals, each of the terminals exposing a portion of the signal lines; and at least two terminal protectors coupled to respective ones of the terminals, extending from a side of the conductive line unit, and surrounding the respective ones of the terminals, the terminal protectors comprising a first terminal protector and a second terminal protector, wherein the signal lines extend along at least a portion of each of the first and second terminal protectors, and wherein an innermost one of the signal lines extending along the first terminal protector is an outermost one of the signal lines extending along the second terminal protector.

* * * * *